United States Patent [19]

Wivinis

[11] 4,040,287

[45] Aug. 9, 1977

[54] PULLING TOOL AND METHOD

[76] Inventor: Gerald P. Wivinis, 3325-B Beacon St., North Chicago, Ill. 60064

[21] Appl. No.: 686,049

[22] Filed: May 13, 1976

[51] Int. Cl.[2] ..... B21D 1/12

[52] U.S. Cl. ..... 72/479; 72/705

[58] Field of Search ..... 72/705, 476, 477, 479

[56] References Cited

U.S. PATENT DOCUMENTS

| | | | |
|---|---|---|---|
| 2,771,933 | 11/1956 | Edwards | 72/705 X |
| 2,900,853 | 8/1959 | Steck | 72/705 X |
| 3,641,805 | 2/1972 | Reinke | 72/705 X |

*Primary Examiner*—C.W. Lanham
*Assistant Examiner*—D. M. Gurley
*Attorney, Agent, or Firm*—Dominik, Knechtel, Godula & Demeur

[57] ABSTRACT

A pulling tool which comprises a pulling bar which, in a simple form, comprises an L-shaped length of tool steel rod and a pulling hook which comprises a length of tool steel rod having a hook formed in one end thereof for hooking the pulling hook with one leg of the pulling bar. The opposite end of the pulling hook can be adapted to have coupling means affixed to it for pulling on the pulling hook.

To use the pulling tool, two holes are drilled in the body of the vehicle in the damaged area, and in spaced apart relationship. One leg of the L-shaped pulling bar is inserted through one of the holes, and the pulling bar is manipulated so that the leg extended through the hole extends substantially parallel with the surface contour of the body of the vehicle, and so as to project towards the second hole drilled in the body. The hook on the pulling hook then is extended through the other hole formed in the body of the vehicle and hooked with the leg of the pulling bar. In this fashion, a pulling force can be exerted on the body of the vehicle to repair the damaged area thereof by pulling on one or both of the pulling hook and the pulling bar. The need to remove any body panels to gain access to the back side of the body to secure the pulling tool to the body therefore is eliminated. Also, both the pulling bar and the pulling hook are formed in a manner such as to prevent the formation of a dimple in the body, upon exerting a pulling force on the pulling tool to remove the dent from the body.

6 Claims, 9 Drawing Figures

FIG. 6
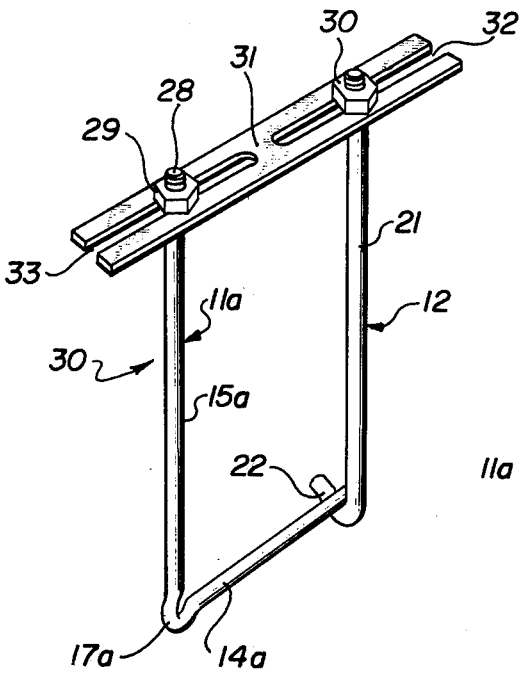
FIG. 7
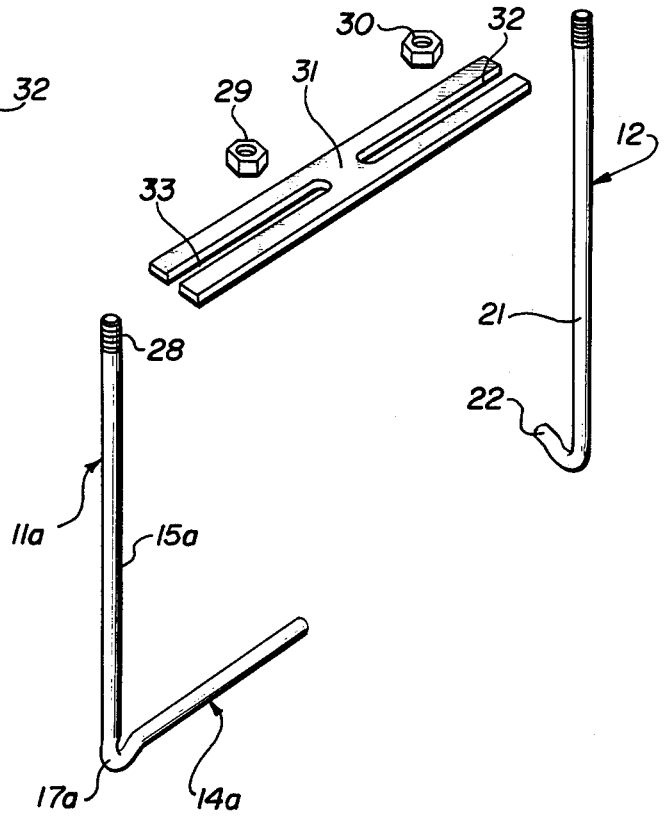
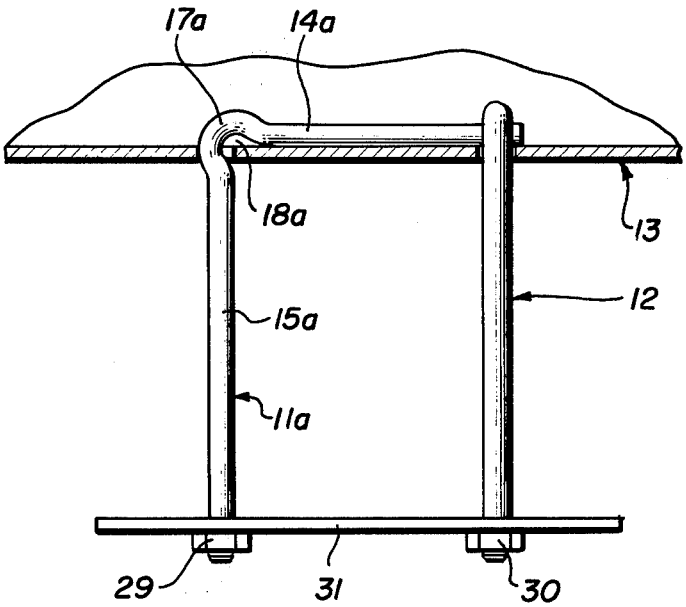
FIG. 8
FIG. 9
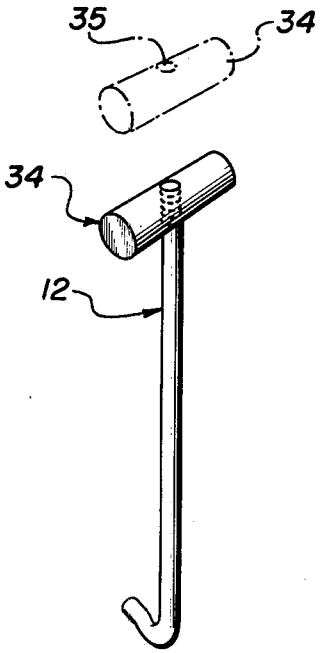

PULLING TOOL AND METHOD

BACKGROUND OF THE INVENTION

This invention relates to an improved pulling tool and; more particularly; to an improved pulling tool which can be used in body shops for removing dents and the like from the bodies of vehicles such as automobiles, trucks and the like.

There are presently available different types of so-called pulling tools which are used in body shops to remove dents and/or straighten parts of vehicle bodies that had been dented or otherwise damaged in an accident or the like. While most of these pulling tools are generally satisfactory, they do suffer various objectionable features. For example, one such pulling tool is essentially a length of tool steel rod which is threaded on one end thereof to receive a washer and a nut, and the opposite end thereof is adapted to be coupled with means for pulling on the rod. The pulling tool is attached to, for example, the door of an automobile by first drilling a hole in the door to accept the threaded end of the rod, then the washer is placed on the rod and secured thereon by means of the threaded nut. The washer and threaded nut are on the rod, on the opposite side of the door. The disadvantage of this pulling tool and its method of attaching it to a door is apparent in that some access must be provided to the back side of the door. This, of course, necessitates the removal of the door panels, a task which at the very least is time consuming. In view of present day labor costs, this adds substantially to the cost of repairing the vehicle.

Another disadvantage of many of the available pulling tools is that they create an outwardly flared protrusion or dimple on the body surface, when a dent or the like is pulled out of the body . More specifically, normally when a dent or the like is removed, the damaged area is pulled such that that aea substantially corresponds with the overall surface contour, and then the damaged area is leaded in and ground to provide a smooth surface matching the original surface contour. In many cases, in pulling the damaged area, the pulling tool creates a dimple at its point of attachment to the body which projects beyond the to-be-established surface contour and which therefore results in the problem of having to somehow remove this dimple. Sometimes the problem in removing this dimple is a greater problem than removing or pulling the dent.

The above generally recites several of the disadvantages of available pulling tools which are overcome by the pulling tool of the present invention.

Accordingly, it is an object of the present invention to provide an improved pulling tool and particularly an improved pulling tool which can be used in body shops for removing dents and the like from the bodies of vehicles such as automobiles, trucks and the like.

BRIEF DESCRIPTION OF THE INVENTION

Generally, the pulling tool of the present invention comprises a pulling bar which, is a simple form, comprises an L-shaped length of tool steel rod and a pulling hook which comprises a length of tool steel rod having a hook formed in one end thereof for hooking the pulling hook with one leg of the pulling bar. The opposite end of the pulling hook can be adapted to have coupling means affixed to it for pulling on the pulling hook.

To use the pulling tool, two holes are drilled in the body of the vehicle in the damaged area, and in spaced apart relationship. One leg of the L-shaped pulling bar is inserted through one of the holes, and the pulling bar is manipulated so that the leg extended through the hole extends substantially parallel with the surface contour of the body of the vehicle, and so as to project towards the second hole drilled in the body. The hook on the pulling hook then is extended through the outer hole formed in the body of the vehicle and hooked with the leg of the pulling bar. In this fashion, a pulling force can be exerted on the body of the vehicle to repair the damaged area thereof by pulling on one or both of the pulling hook and the pulling bar. The need to remove any body panels to gain access to the back side of the body to secure the pulling tool to the body therefore is eliminated. Also, both the pulling bar and the pulling hook are formed in a manner such as to prevent the formation of a dimple in the body, upon exerting a pulling force on the pulling tool to remove the dent from the body.

BRIEF DESCRIPTION OF THE DRAWINGS

The above and other objectives and features of the invention will become more apparent from the following description and accompanying drawings wherein:

FIG. 6 is a perspective view of a pulling tool constructed in accordance with still another embodiment of the invention;

FIG. 7 is an exploded perspective view of the pulling tool of FIG. 6;

FIG. 8 is a top plan view of the pulling tool of FIGS. 6 and 7, generally illustrating the manner in which it is attached to a vehicle body, the latter being partially sectionalized; and FIG. 9 is a perspective view of a pulling hook in accordance with still another embodiment of the invention.

Figure 1:
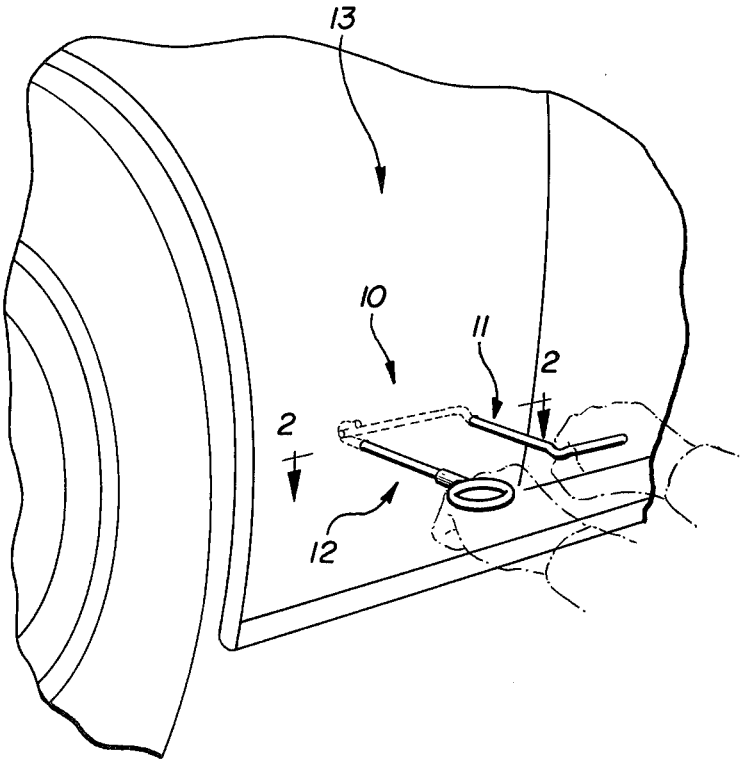
FIG. 1 is a partial view of a vehicle body, generally illustrating a pulling tool exemplary of the present invention and the manner in which it is attached to a vehicle body.

Referrring now to the drawings, in FIG. 1 there is generally illustrated a pulling tool 10 and the manner in which the pulling tool 10 is attached to the body 13 of a vehicle, for the purpose of removing a dent or the like from the body. The pulling tool 10 is a two-piece tool comprising a pulling bar 11 and a pulling hook 12.

Figure 5:
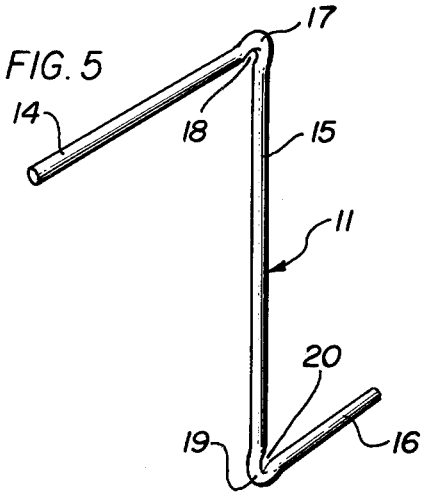
FIG. 5 is a perspective view of a pulling bar in accordance with one embodiment of the invention.
Figure 2:
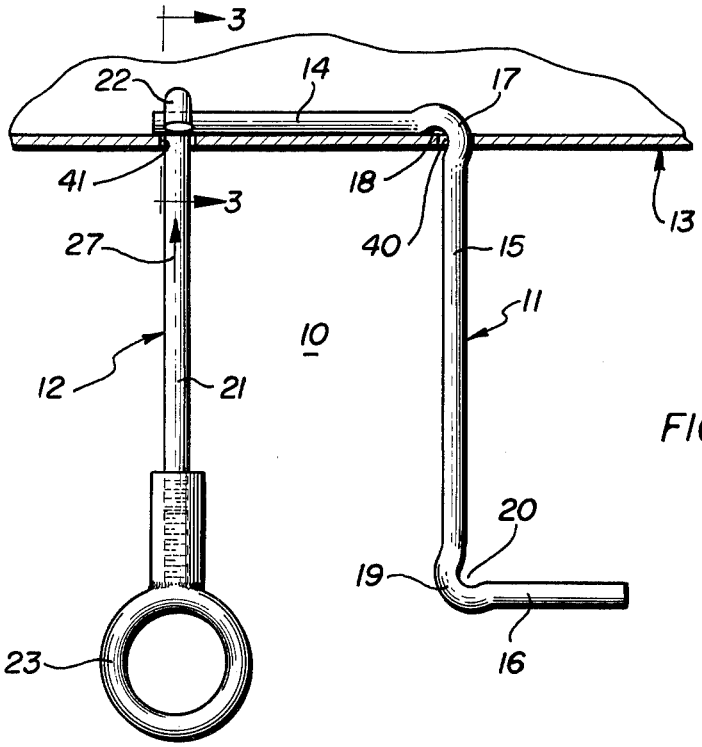
FIG. 2 is a top plan view generally illustrating the manner in which the pulling tool is attached to the vehicle body, the latter being sectionalized.

As can be best seen in FIGS. 1, 2 and 5, the pulling bar 11 comprises two legs 14 and 16 which extend perpendicular to and in opposite directions from a leg 15. While, as illustrated in FIGS. 1, 2, and 5, the pulling bar comprises three legs 14–16, in its simplest form the pulling bar 11 can be simply an L-shaped member comprising a pair of legs 14 and 15. Accordingly, while the pulling tool 11 is illustrated as having an additional leg 16, the latter could be eliminated.

At the L formed by the juncture of the legs 14 and 15, the pulling bar 11 is formed with an outwardly flared radius 17 so as to provide a cavity 18 which effectively prevents the juncture of the legs 14 and 15 from engaging the metal of the body 13 at the point where the pulling tool 11 extends through a hole formed in the body 13, as described more fully below. A corresponding radius 19 is formed in the pulling bar 11, at the juncture of the legs 15 and 16, so as to provide a cavity 20 which functions in the same manner as the cavity 18. The pulling bar 11 preferably and advantageously can be formed of a tool steel rod of a diameter which is preferably at least one-eighth inch or more.

Figure 4:
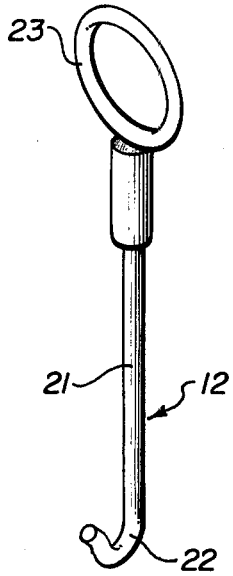
FIG. 4 is a perspective view of a pulling hook in accordance with one embodiment of the invention.
Figure 3:
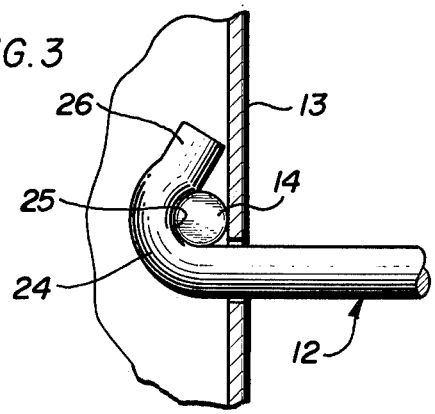
FIG. 3 is a partial side plan view generally illustrating the manner in which the hook on the pulling hook is hooked with the leg of the pulling bar.

As can best be seen in FIGS. 1, 3 and 4, the pulling hook likewise comprises a tool steel rod having a diameter of at least one-eighth inch or more, with a hook 22 formed on one end thereof, with the opposite end thereof being threaded so as to permit, for example, a pulling ring 23 or the like to be threadedly affixed to the pulling hook 12.

As can be best seen in FIG. 3, the hook 22 formed on the one end of the pulling hook 12 is formed with a radius 24 such as to provide a cavity 25 which preferably and advantageously substantially corresponds with the periphery of the leg 14 of the pulling bar 11. Also, the terminal end 26 of the hook 22 is proportioned such that the terminal end 26 will not engage with the metal of the body 13 when the hook 22 is hooked with the leg 14, and the leg 14 is forcibly urged against the metal of the body 13, thus preventing the terminal end 26 from causing a dimple to be formed in the body 13 when a pulling force is exerted on the pulling hook 12.

In use, two holes 40 and 41 first are formed in the body 13 in spaced apart relationship, in the area of the body which is damaged. Obviously, the holes 40 and 41 are placed sufficiently close together so that the pulling hook 12 can be engaged with the leg 14 of the pulling bar 11, as more fully described below After forming the holes 40 and 41 in the body 13, the leg 14, as illustrated, of the pulling bar 11 is inserted through the hole 40, and the pulling bar 11 manipulated to position the leg 14 substantially parallel with the contour of the body 13 and in the direction of the hole 41 formed in the body 13.

Having inserted the leg 14 of the pulling bar 11 through the aperture or hole 40 formed in the body 13, the hook 22 on the pulling hook 12 is inserted through the hole 41 formed in the body 13, and hookingly engaged with the leg 14 of the pulling bar 11, as illustrated. To assist in hookingly engaging the hook 22 on the pulling hook 12 with the leg 14 of the pulling bar 11, the leg 12 can be bent or indicia such as the arrow 27 stamped or otherwise provided on the pulling hook 12 can be provided to indicate the position of the hook 22. Correspondingly, similar indicia can be provided on the leg 15 of the pulling bar 11 to indicate the direction in which the leg 14 extends, in the event the pulling bar 11 is simply an L-shaped member. However, obviously if the pulling bar 11 has the additional leg 16, the latter generally indicates the direction in which the leg 14 extends, so that it is not necessary to provide additional indicia on the leg 15.

A pulling force can now be asserted on the body 13 of the vehicle to remove a dent or the like, by applying a pulling force to the pulling hook 12, or both to the pulling bar 11 and the pulling hook 12. In certain cases, the pulling force exerted on the body 13 can be a pulling force exerted on the pulling tool 10 simply by grasping the respective ones of the pulling bar 11 and pulling hook 12 with the hands and pulling on them, as illustrated in FIG. 1. Alternatively, should an additional pulling force be necessary, hydraulic or other types of pulling means can be coupled to the pulling hook 12, by means of the pulling ring 23. In either case, the pulling force exerted on the pulling hook 12 or on both the pulling bar 11 and the pulling hook 12 is translated to the body 13 by the cooperative action of the pulling bar 11 and the pulling hook 12, the two being coupled together by means of the hook 22 being hookingly engaged with the leg 14 of the pulling bar 11.

Accordingly, it can be seen that a pulling force can be exerted on the body 13 of a vehicle to remove a dent or the like from the body 13, without the necessity of removing any panels or the like to gain access to the rear side of the body, as in the case of most existing pulling tools. It is only necessary that two holes be formed in the body 13, so that the one leg of the pulling bar 11 can be extended through the hole to engage it against the rear side of the body. Obviously, in some cases, it may only be necessary to use the pulling bar 11 to remove a dent, depending upon how much force is required to remove the dent from the body. However, preferably and advantageously, the pulling hook 12 is used in combination with the pulling bar 11, in the manner described above, to remove dents.

As can be best seen in FIG. 2, when the leg 14 of the pulling bar 11 is engaged with the body 13 of a vehicle, the edge of the body 13 about the hole 40 formed in the body for receiving the leg 14 of the pulling tool 11 projects into the cavity 18 provided by the radiused corner 17 on the pulling bar 11. Accordingly, when a force is exerted on the pulling bar 11, the force is translated along the length of the leg 14, and the leg 14, or the juncture between the leg 14 and the leg 15, is prevented from engaging the body 13, thus the pulling bar 11 is prevented from causing or forming a dimple in the body 13, as in the case of many existing pulling tools. Further still, as indicated above, and as can be best seen in FIG. 3, the terminal end 26 of the pulling hook 12 is prevented from engaging with the body 13 of the vehicle, so that the pulling hook 12 likewise is prevented from causing or forming a dimple in the body 13 of the vehicle. Accordingly, the pulling tool 10 provides the advantage of exerting a force on the back side of the body 13 of a vehicle to remove a dent from the body 13, without the necessity of having to remove any panels, as previously normally required. Also, the pulling tool 10 prevents any dimples or the like from being formed in the body 13, when a force is exerted on the pulling tool to remove a dent.

In FIGS. 6, 7 and 8, there is illustrated a pulling tool 30 which is generally like the pulling tool 10, however, in this case, the pulling bar 11 is simply an L-shaped member having a pair of legs **14*a* and 15*a*, with the terminal end of the leg 15*a* being provided with threads 28 to receive a threaded nut 29. Likewise, a threaded nut 30 is provided for the one end of the pulling hook 12**.

A slotted bar 31 having oppositely extending slots 32 and 33 formed in it, is provided for use in conjunction with the pulling bar **11*a* and the pulling hook 12. The slotted bar 31 preferably and advantageously is of a heavy gauge metal material to permit hydraulic means or the like to be attached to the pulling tool 12, so that a far greater pulling force can be asserted on the pulling tool 30**.

As can be seen in FIG. 8, the pulling tool 30 is attached to the body 13 of a vehicle, in the same fashion as the pulling tool 10 described above. Once having attached the pulling tool 30 to the body 13, the slotted bar 31 can be affixed to the terminal ends of the pulling bar 11*a* and the pulling hook 12, by inserting them into the respective slots 32 and 33 and affixing the threaded nuts 29 and 30 thereto. Such an arrangement for the pulling tool may be used, for example, in those situations where a fairly substantial force is required to pull a dent out of a vehicle body, particularly in the inner heavy steel metal reenforcement bars or braces presently being used in the doors of most motor vehicles.

In FIG. 9, there is illustrated a pulling hook 12 which, instead of having a pulling ring 23, as illustrated in FIG. 4, threadedly affixed to it, has a handle 34 in the form of a cylindrical member with a threaded aperture 35 in it, for permitting the handle 34 to be threadedly affixed to the pulling hook 12. The handle 34 permits the pulling hook 12 to be gripped by means of the handle 34, to exert a pulling force on the pulling tool.

It will thus be seen that the objects set forth above, among those made apparent from the preceding description, are efficiently attained and certain changes may be made in carrying out the above method and in the construction set forth. Accordingly, it is intended that all matter contained in the above description or shown in the accompanying drawings shall be interpreted as illustrative and not in a limiting sense.

Now that the invention has been described, what is claimed as new and desired to be secured by Letters Patent is:

1. A pulling tool comprising, in combination: a first pulling member having a pair of legs which are formed generally L-shaped, and a second pulling member of an extended length having hook means formed on one end thereof which is adapted to releasably hookingly engage with one of said legs of said first pulling member and coupling means on the other end thereof for permitting said second pulling member to be pulled; one of said legs of said first pulling member being inserted through a first aperture formed in an object and said first pulling member being manipulated such that said one of said legs is disposed to extend generally parallel with said object; said hook means on said second pulling member being inserted through a second aperture which is formed in the object in a spaced and laterally variable position relative to the first aperture and being releasably hookingly engaged with said one of said legs, said first pulling member at the juncture of said pair of legs being formed with an offset radius so as to provide a recessed cavity into which the edge of the object about said first aperture extends to prevent the formation of a dimple on the object when a pulling force is exerted on the pulling tool, whereby a pulling force exerted on at least said second pulling member is translated to the object by the cooperative action of said first and second pulling members.

2. The pulling tool of claim 1, wherein said first pulling member has a third leg integrally formed with it which extends laterally in the opposite direction to form another L-shape in said first pulling member, the junction of the pair of legs forming this other L-shape being formed with an offset radius so as to provide a recessed cavity into which the edge of the object about an aperture can extend to prevent the formation of a dimple on the object when a pulling force is exerted on the pulling tool.

3. The pulling tool of claim 1, wherein one end of one of said pair of legs of said first pulling member is threaded to receive a threaded nut and wherein the coupling means on the one end of said second pulling means comprises threads, said pulling tool further comprising a slotted bar having a pair of oppositely extending slots formed in it for receiving therethrough the respective threaded ends of said first and second pulling members, and a pair of threaded nuts affixed to the threaded ends of said first and second pulling members to secure said slotted bar to said first and second pulling members.

4. The pulling tool of claim 1, wherein said first and second pulling members are formed of tool steel rod.

5. The pulling tool of claim 1, wherein said coupling means on said second pulling members comprises threaded means, and a handle threadedly affixed to said second pulling member.

6. The pulling tool of claim 1, further including means for releasably coupling the free end of the respective ones of said first and second pulling members together, once said first and second pulling members are affixed to an object.

* * * * *